United States Patent [19]

Lindahl

[11] 4,232,619

[45] Nov. 11, 1980

[54] LIFTING LOOP

[75] Inventor: Bengt E. Lindahl, Gothenburg, Sweden

[73] Assignee: Svensk Lasthantering, Bengt Lindahl AB, Torslanda, Sweden

[21] Appl. No.: 899,734

[22] Filed: Apr. 25, 1978

[51] Int. Cl.[3] ..... D05B 93/00

[52] U.S. Cl. ..... 112/417; 112/420; 112/441; 190/59; 294/74

[58] Field of Search ..... 112/417, 418, 419, 420, 112/429, 440, 441, 139; 36/78; 224/45; 190/55 R, 57, 59; 294/74, 75, 76

[56] References Cited

U.S. PATENT DOCUMENTS

| | | | |
|---|---|---|---|
| 1,403,167 | 1/1922 | Kahlow | 190/57 |
| 1,765,884 | 6/1930 | Schemmel | 112/417 X |
| 1,820,935 | 9/1931 | Buhler | 112/417 X |
| 1,990,873 | 2/1935 | Lenz | 112/417 |
| 2,519,604 | 8/1950 | Ronolt | 190/57 |
| 2,628,695 | 2/1953 | Rognsvoog | 190/57 |

*Primary Examiner*—H. Hampton Hunter

*Attorney, Agent, or Firm*—Harness, Dickey & Pierce

[57] ABSTRACT

A lifting loop comprising a core of parallel threads enclosed in a protecting covering which is formed by a woven ribbon that is stitched together at its edges whereby a side seam extending in the longitudinal direction of the loop is formed and the covering is made to enclose said core snugly. A second longitudinal seam may be stitched diametrically opposed to the first seam. In a simple manner is thus produced a reliable lifting loop possessing highly satisfactory lifting characteristics and maximum durability and strength.

2 Claims, 6 Drawing Figures

VI
VI
III
III

LIFTING LOOP

BACKGROUND OF THE INVENTION

The present invention relates to a lifting loop of the type comprising a core of parallel threads enclosed in a protecting covering which is retained in position about the core by means of a seam stitched in the longitudinal direction of the loop.

Lifting loops or slings are already known which are provided with a central seam penetrating entirely through the core of the sling. This central seam draws together the centre portion of the sling in such a manner as to render the core compact and ensure that the covering encloses the latter snugly and securely.

One drawback of producing roundslings with a central seam of this type is that the design of sewing machines imposes a reduction of the size (coarseness) of the sling and therefore of its load-bearing capacity and strength to comparatively low values. Another drawback is that the central seam is exposed to wear from the load carried by the sling or from the lifting hook from which the sling is suspended, and therefore the seam often breaks before the breaking point of the sling is reached. Once the seam snaps off at one point, the core threads no longer are kept tightly together at this point that thus forms a weakened zone of the sling, which needs replacement or repair.

To eliminate the drawbacks outlined above, seamless roundslings may be produced. Such slings are manufactured by positioning a covering in the form of a hose around a tightly closed bundle of fibres, whereafter the ends of the covering are placed in overlapping position and are interconnected. However, this method is complicated and it is difficult to fill the covering to a satisfactory degree, with the result that during loading operations the fibres might be shifted and their orientation therefore disadvantageous. As a consequence they may be unevenly loaded, which causes ruptures of individual fibres and therefore a reduction of the load-bearing capacity of the loop.

SUMMARY OF THE INVENTION

The subject invention is a development of the type of roundsling that is provided with a lengthwise seam. The characteristic features of the invention are that the seam is a side seam and that when the protective covering is stitched together at its edges the seam makes the covering enclose the core snugly. A seam of this kind will not be exposed to significant wear during loading operations, while at the same time the fibres will be orientated in their correct working positions during the very manufacture of the loop in that care is taken to ensure that the fibres fill the internal space of the covering completely. In this manner one gains the advantage that the loop, in all sizes of manufacture thereof, will always have the maximum strength and durability.

As a further development of the invention, the covering may be provided with two diametrically opposed side seams.

BRIEF DESCRIPTION OF THE DRAWING

The invention will be described in closer detail in the following with reference to the accompanying drawing, wherein.

DETAILED DESCRIPTION OF A PREFERRED EMBODIMENT

Figures 1, 2, 3, 4, 5, 6:
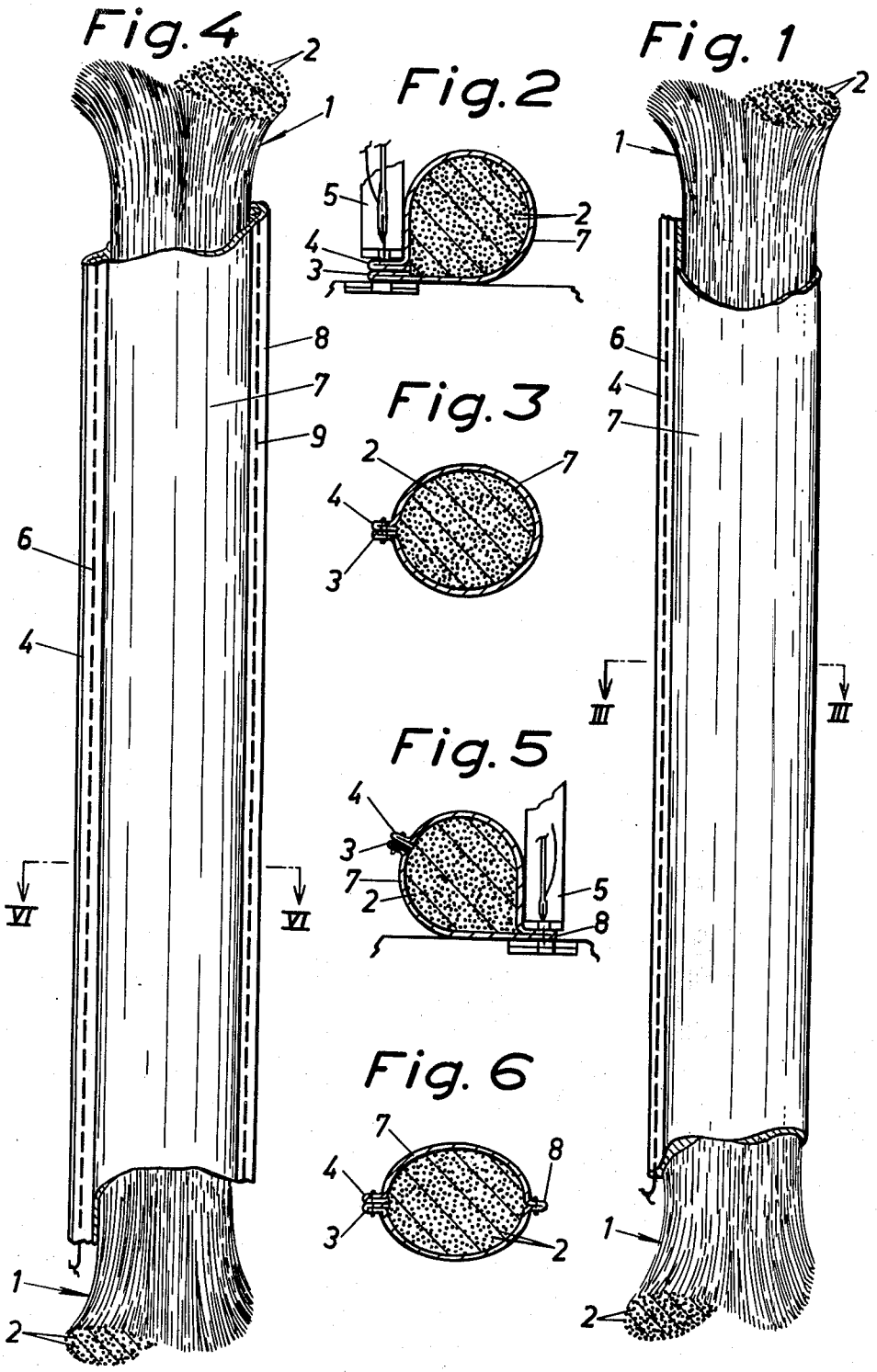
FIG. 1 is a length of a lifting loop manufactured in accordance with the teachings of the invention.
FIG. 2 is a cross-sectional view through the loop while being stitched together.
FIG. 3 is a section along line III—III of FIG. 1.
FIG. 4 is a length of a lifting loop in accordance with a second embodiment.
FIG. 5 is a cross-sectional view through this loop while being provided with its second seam.
FIG. 6 is a section along line VI—VI of FIG. 4.

Like prior-art designs of lifting loops, the sling in accordance with the subject invention comprises a core 1 of fibres or threads 2, preferably consisting of 100% polyester. The core 1 is enclosed by a cloth, preferably of the same material and woven as a ribbon. When enclosed by this ribbon, the fibres or threads are well compressed in accordance with the invention and the selvedges 3,4 of the ribbon are folded and passed beneath the presser foot 5 of a sewing machine, and the selvedges are stitched together whereby a side seam 6 is formed. The ribbon now forms a hose-like protection covering 7 around the core 1.

The protecting covering 7 could be made to enclose the core snugly by the use of one side seam 6 in accordance with the invention. In addition, this possibility is improved the thicker the loop that is manufactured. When producing loops that are less coarse or when one wants to make coarse loops even tighter it is possible, in accordance with a further development of the invention, to form a lengthwise extending lateral fold 8 on the side of the covering 7 that is diametriacally opposed to the seam 6 and stitch a second side seam 9 along this fold.

In both cases the side seam 6 or side seams 6 and 9 of the resulting lifting loop will not snap before the breaking strength of the sling itself is exceeded. Despite the extreme simplicity of manufacture, the lifting loop in accordance with the invention thus provides maximum reliability.

What we claim is:

1. An improved flexible lifting loop of sufficient length to encircle and support a large lifting load comprising a core of parallel threads, a protecting covering enclosing said core and retained about said core by a seam extending in the longitudinal direction of the loop, the improvement comprising said seam being a side seam, said threads and said covering having sufficient flexibility to conform to the shape of a lifting hook or the like and the engaged portion of the lifted load, said seam when stitching together said protecting covering making said covering enclose said core snugly and retain said threads in their parallel relationship when said loop is engaged with a load.

2. An improved lifting loop according to claim 1, comprising two side seams stitched in said covering in diametrically opposed positions.

* * * * *

REEXAMINATION CERTIFICATE (348th)

United States Patent [19]

Lindahl

[11] B1 4,232,619

[45] Certificate Issued May 14, 1985

[54] LIFTING LOOP

[75] Inventor: Bengt E. Lindahl, Gothenburg, Sweden

[73] Assignee: Svensk Lasthantering, Bengt Lindahl AB, Torslanda, Sweden

Reexamination Request:
No. 90/000,016, Jul. 2, 1981

Reexamination Certificate for:

| | |
|---|---|
| Patent No.: | **4,232,619** |
| Issued: | **Nov. 11, 1980** |
| Appl. No.: | **899,734** |
| Filed: | **Apr. 25, 1978** |

[51] Int. Cl.[3] ..... D05B 93/00

[52] U.S. Cl. ..... 112/417; 112/420; 112/441; 190/59; 294/74

[58] Field of Search ..... 112/417, 418, 419, 420, 112/429, 440, 441, 139; 36/78; 224/45; 190/55 R, 57, 59; 294/74, 75, 76

[56] References Cited

FOREIGN PATENT DOCUMENTS

| | | |
|---|---|---|
| 2129837 | 12/1971 | Fed. Rep. of Germany . |
| 1228562 | 8/1960 | France . |
| 1446935 | 8/1976 | United Kingdom . |

*Primary Examiner*—H. Hampton Hunter

[57] ABSTRACT

A lifting loop comprising a core of parallel threads enclosed in a protecting covering which is formed by a woven ribbon that is stitched together at its edges whereby a side seam extending in the longitudinal direction of the loop is formed and the covering is made to enclose said core snugly. A second longitudinal seam may be stitched diametrically opposed to the first seam. In a simple manner is thus produced a reliable lifting loop possessing highly satisfactory lifting characteristics and maximum durability and strength.

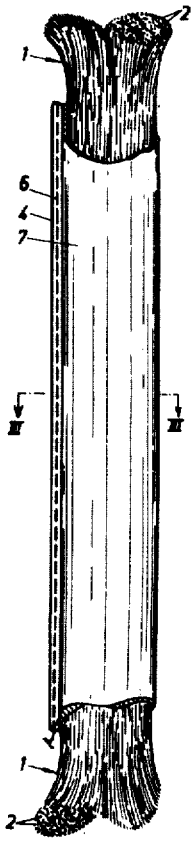

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–6 are cancelled.

* * * * *